US009784548B2

(12) United States Patent
Soohoo et al.

(10) Patent No.: US 9,784,548 B2
(45) Date of Patent: Oct. 10, 2017

(54) VENTED-AT-TEMPERATURE IGNITER

(71) Applicant: Fike Corporation, Blue Springs, MO (US)

(72) Inventors: Ed Soohoo, Stanhope, NJ (US); Raivo Kull, West Caldwell, NJ (US); Will Greeley, Lafayette, NJ (US)

(73) Assignee: Fike Corporation, Blue Springs, MO (US)

( * ) Notice: Subject to any disclaimer, the term of this patent is extended or adjusted under 35 U.S.C. 154(b) by 0 days.

(21) Appl. No.: 14/711,251

(22) Filed: May 13, 2015

(65) Prior Publication Data

US 2015/0330757 A1 Nov. 19, 2015

Related U.S. Application Data

(60) Provisional application No. 61/993,002, filed on May 14, 2014.

(51) Int. Cl.

| | |
|---|---|
| ***F42C 15/34*** | (2006.01) |
| ***F42D 1/00*** | (2006.01) |
| ***F42C 19/10*** | (2006.01) |
| ***E21B 43/11*** | (2006.01) |
| ***E21B 43/1185*** | (2006.01) |

(52) U.S. Cl.

CPC ..... *F42C 15/34* (2013.01); *E21B 43/11* (2013.01); *E21B 43/1185* (2013.01); *F42C 19/10* (2013.01); *F42D 1/00* (2013.01)

(58) Field of Classification Search

CPC ..... F02K 9/38; F42B 39/20
USPC ..... 102/481, 357, 202.1, 206, 200
See application file for complete search history.

(56) References Cited

U.S. PATENT DOCUMENTS

| | | | | |
|---|---|---|---|---|
| 3,228,191 | A * | 1/1966 | Zeman | F02K 9/95 60/256 |
| 4,135,454 | A | 1/1979 | Morris et al. | |
| 4,458,482 | A * | 7/1984 | Vetter | F42B 39/20 102/481 |
| 4,881,445 | A * | 11/1989 | Hayes | F42B 3/08 102/306 |
| 4,905,722 | A | 3/1990 | Rooker et al. | |
| 5,035,182 | A * | 7/1991 | Purcell | F42B 39/20 102/293 |
| H1144 | H * | 3/1993 | Cherry | F42B 39/20 102/481 |

(Continued)

OTHER PUBLICATIONS

The International Search Report and Written Opinion dated Aug. 24, 2015, in PCT/US2015/030488, filed May 13, 2015.

*Primary Examiner* — Reginald Tillman, Jr.
(74) *Attorney, Agent, or Firm* — Hovey Williams LLP

(57) ABSTRACT

A vented pyrotechnic device is provided that hermetically seals the pyrotechnic material contained therein under ambient storage conditions, but vents upon exposure to elevated-temperature conditions at or below the outgassing temperature for the pyrotechnic material. The vent passage communicating the chamber containing the pyrotechnic material with the exterior of the device is initially sealed at ambient storage conditions by a temperature-sensitive material. When exposed to a predetermined temperature condition, the temperature-sensitive material undergoes a physical change unblocking the passage and permitting venting of off gases produced by the pyrotechnic material.

25 Claims, 3 Drawing Sheets

(56) References Cited

U.S. PATENT DOCUMENTS

| | | | | |
|---|---|---|---|---|
| 7,739,956 | B2 * | 6/2010 | Ljungwald | F42B 39/20 102/481 |
| 7,806,035 | B2 * | 10/2010 | Kaiser | E21B 43/119 175/4.54 |
| 8,668,110 | B1 * | 3/2014 | Traxler | F42B 39/20 220/202 |
| 8,833,591 | B2 * | 9/2014 | Kotevski | F42B 39/20 206/3 |
| 8,943,970 | B2 | 2/2015 | Greeley et al. | |
| 2013/0220161 | A1 | 8/2013 | Coppedge et al. | |
| 2013/0277108 | A1 | 10/2013 | Greeley et al. | |
| 2013/0291754 | A1 * | 11/2013 | Kotefski | B65D 90/32 102/481 |
| 2013/0327544 | A1 | 12/2013 | Carisella | |

* cited by examiner

VENTED-AT-TEMPERATURE IGNITER

RELATED APPLICATION

The present application claims the benefit of U.S. Provisional Patent Application No. 61/993,002, filed May 14, 2014, which is incorporated by reference herein in its entirety.

BACKGROUND OF THE INVENTION

Field of the Invention

The present invention is generally directed toward pyrotechnic devices in which the primary pyrotechnic charge is hermetically sealed within the device for storage under ambient temperature conditions, but is configured to be vented when exposed to elevated-temperature conditions, such as might be encountered in extreme downhole environments. The devices comprise a passage between an internal chamber containing the pyrotechnic charge and the exterior of the device that is normally sealed with a temperature-sensitive material. Upon exposure to elevated-temperature conditions, the temperature-sensitive material releases thereby opening the passage so that off gases generated by the pyrotechnic material upon exposure to high temperatures may be vented away, thereby slowing the thermal deactivation of the pyrotechnic material.

Description of the Prior Art

Explosive materials are often utilized in oil well completion operations, such as in perforating the well casing to permit communication of the underground formation with the well bore. Often, pyrotechnic devices are used to initiate detonation of these explosive materials. These pyrotechnic devices can include fuses comprising time delays that are ignited with an igniter device. Actuation of the igniter device results in ignition of an output charge that in turn ignites a further pyrotechnic device, such as the aforementioned fuse. The output charge comprises a pyrotechnic material, such as lead azide, lead styphnate, and 2,2',4,4',6,6'-hexanitrostilbene (HNS-II).

Downhole environments can be quite extreme as compared to conditions at the surface. It is not uncommon for temperatures downhole to exceed 200° F., particularly at extreme depths of 5000 ft. or more. Prolonged exposure to prolonged elevated temperatures can result in the thermal decomposition of the pyrotechnic material used in the initiator. This thermal decomposition generally results in the generation of gaseous products, such as nitrogen, oxygen, and ammonia, depending upon the composition of the pyrotechnic material present in the initiator. Typically, the thermal decomposition of the pyrotechnic material at elevated temperatures as might be encountered downhole progresses slowly. However, the presence of these off gases further accelerates deactivation of the pyrotechnic material at the elevated temperature conditions. If a significant period of time passes between downhole insertion and use of the igniter device, the pyrotechnic material may have degraded to the extent that it no longer is capable of ignition or providing a sufficient explosive output leading to operational downtime.

Thus, there exists a need in the art for an igniter device capable of prolonged exposure to downhole elevated-temperature conditions without the pyrotechnic material contained therein becoming deactivated.

SUMMARY OF THE INVENTION

Embodiments of the present invention overcome the aforementioned problems of pyrotechnic material thermal deactivation by providing devices capable of venting off gases released as a result of exposure of the pyrotechnic material to elevated temperature conditions as might be encountered in downhole operations.

According to one embodiment of the present invention there is provided a pyrotechnic device comprising a device body having an outer sidewall and an interior chamber that contains an explosive output charge that is sealed within the body. The chamber comprises opposed input and output ends, and there is a frangible member disposed in covering relationship to the output end. The device further comprises a vent passage extending between the chamber and the exterior of the body. The vent passage is sealed with a temperature-sensitive material that, upon heating of the device to a predetermined temperature, unseals the vent passage and permits communication between the chamber and the exterior of the device body.

According to another embodiment of the present invention there is provided a pyrotechnic igniter comprising an igniter body having an outer sidewall and an interior chamber containing an explosive output charge that is hermetically sealed within the body. The chamber comprises opposed input and output ends, and there is a rupture disc disposed in covering relationship to the output end. The rupture comprises an orifice formed therethrough that defines a passage extending between the chamber and the exterior of the igniter body. The orifice is hermetically sealed with a solid solder material that, upon heating of the igniter to a predetermined temperature, melts thereby unsealing the passage and permitting communication between the chamber and the exterior of the igniter body. The device further comprises a percussion igniter that is operable to initiate ignition of the explosive output charge.

According to yet another embodiment of the present invention there is provided a method of venting a pyrotechnic device containing a pyrotechnic material. The method comprises providing a pyrotechnic device comprising a device body having an interior chamber that contains an explosive output charge sealed therein. The device includes a passage extending between the chamber and the exterior of the body. The passage includes a temperature-sensitive material disposed therein blocking communication between the chamber and the exterior of the body. The device is then introduced into an elevated-temperature environment sufficient to cause the temperature-sensitive material to unseal the passage thereby opening communication between the chamber and the exterior of the body through the passage.

DETAILED DESCRIPTION OF THE PREFERRED EMBODIMENT

Figure 2:
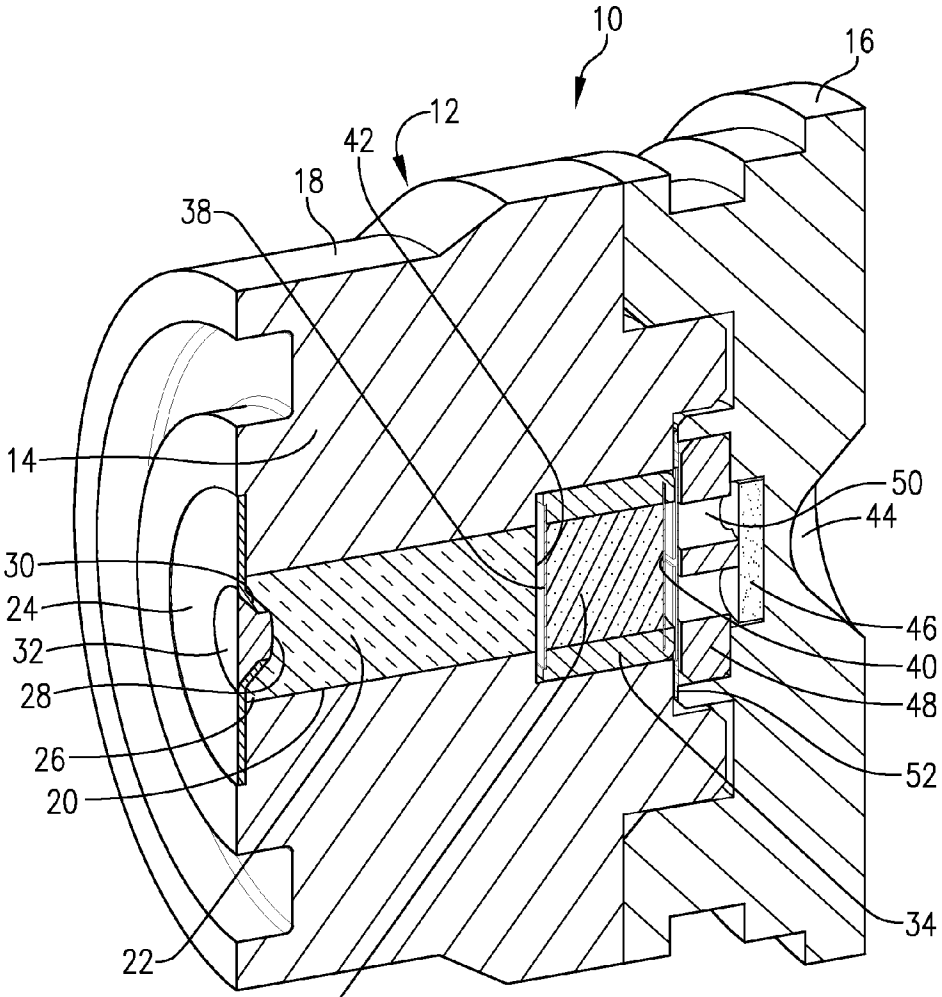
FIG. 2 is a cross-sectional view of the igniter device of FIG. 1.
Figure 1:
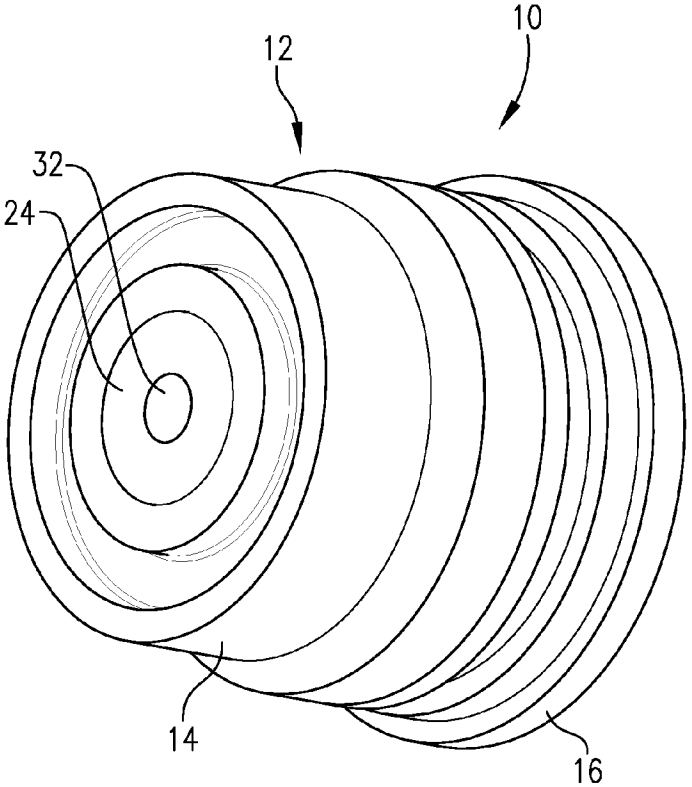
FIG. 1 illustrates a pyrotechnic igniter device, and in particular the output end thereof comprising a rupture disc and a solder-filled passage.

Turning now to FIGS. 1 and 2, a pyrotechnic device 10 made in accordance with one embodiment of the present invention is illustrated that is configured to permit venting of off gases generated by pyrotechnic material contained therein. Device 10 generally comprises a device body 12 including an output section 14 and a percussion igniter 16. Output section 14 comprises an outer sidewall 18 and an interior chamber 20. An output charge 22 is contained within chamber 20 that upon ignition thereof is capable of generating sufficient energy to initiate firing of a downstream pyrotechnic or explosive material. Output charge 22 may be any suitable pyrotechnic material for accomplishing this function. In certain embodiments, the pyrotechnic material is one that while generally stable at high temperatures will tend to thermally decompose upon prolonged exposure to such conditions thereby producing off gases. Exemplary pyrotechnic materials making up output charge 22 include lead azide, lead styphnate, 2,6-bis(picrylamino)-3,5-dinitropyridine (PYX), and 2,2',4,4',6,6'-hexanitrostilbene (HNS-II). Thermal decomposition of the pyrotechnic materials may result in the generation of various gases comprising elemental components of the pyrotechnic material, including nitrogen, oxygen, and ammonia.

Figure 3:
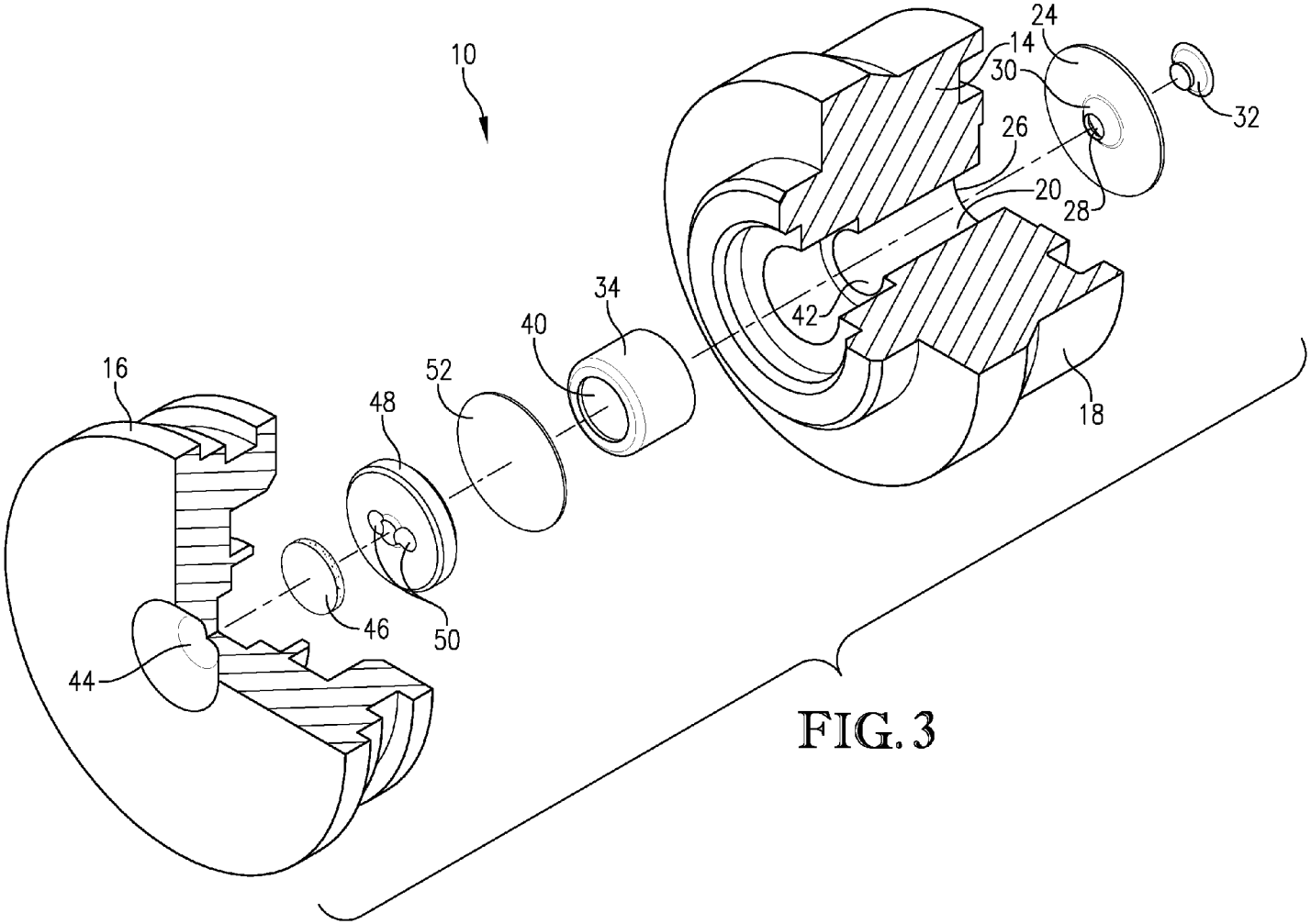
FIG. 3 is an exploded, sectioned view of the igniter device of FIG. 1.

Output section 14 further comprises a frangible member 24, such as a rupture disc, installed over an output end 26 of interior chamber 20. As shown in FIG. 3, member 24 comprises a vent passage 28 that extends between chamber 20 and the outside of body 12. In certain embodiments, passage 28 comprises an orifice in member 24 that may be formed using a punch or other tool. Impacting member 24 with a punch during formation of the orifice may further cause deformation of the member 24 resulting in creation of a bulged section 30. It is within the scope of the present invention for passage 28 to comprise other types of openings formed in member 24, such as a slit or series of perforations, which may be formed by a mechanical or laser milling process.

It is undesirable for output charge 22 to be exposed to the outside environment during storage of device 10. Therefore, output charge 22 must be sealed within chamber 20, and preferably hermetically sealed, thereby preventing infiltration of external contaminants, such as moisture, into chamber 20 and the pyrotechnic material contained therein. Passage 28 is sealed with a temperature sensitive material 32 that, upon exposure to a predetermined temperature condition, unseals passage 28, preferably by changing phases, and permits communication between chamber 20 and the exterior of the device body 12.

In certain embodiments, material 32 is a low-melting point alloy or eutectic, such as a solder, that creates a mechanically strong hermetic seal to protect the pyrotechnic material contained within device 10 during storage and installation within a downhole tool. In certain embodiments, the material 32 comprises a tin or lead-based solder such as TIX® 54.808 Soft Solder, which comprises approximately 93% tin/4.6% indium/2.3% lead. The solder may be installed within passage 28 using a flux material such as All-State® Duzall® flux. It is within the scope of the present invention for other temperature-sensitive materials to be used to hermetically seal passage 28, such as adhesives or synthetic resin materials. Regardless of the temperature-sensitive material selected, in particular embodiments, the material undergoes a phase change thereby unsealing passage 28 at a temperature that is lower than the outgassing temperature of the pyrotechnic material comprising output charge 22. Most commonly, the phase change that material 32 undergoes to unseal passage 28 is a change from solid to liquid (i.e., melting); however, it is within the scope of the present invention for material 32 to sublime, or change directly from solid to a gas, upon exposure to conditions at or below those that might result in thermal decomposition of the pyrotechnic contained within chamber 20. In particular embodiments, the temperature-sensitive material 32 unseals passage 28 at a temperature of at least 150° F., 175° F., 200° F. or 250° F., but less than 500° F., 450° F., 400° F., or 350° F.

It is noted that frangible member 24 and temperature-sensitive material 32 are distinguishable from laminate composite rupture disc structures, such as those disclosed in U.S. Pat. No. 4,905,722 in which a rupture member having openings formed therein is provided with a plastic sealing member overlying and sealing the openings. In certain embodiments, the temperature-sensitive material not only overlays vent passage 28, but may reside within the passage thereby providing a strong, hermetic seal. Thus, in certain embodiments of the present invention, the use of polymeric or plastic membranes and coatings are avoided as these coverings do not offer a rugged, reliable seal under extreme conditions such as might be encountered in a subterranean wellbore. Moreover, the plastics from which these coverings are made can outgas under the same or even lower temperature conditions as might also result in the outgassing of the pyrotechnic material contained within chamber 20. These off gases, which may be similar in composition to the off gases produced by the thermal decomposition of the pyrotechnic material, would further accelerate the deactivation of the pyrotechnic material.

It is also an important for material 32 to not affect the bursting characteristics of frangible member 24, or at least not affect the bursting characteristics in an unknown or uncontrollable manner. Thus, in certain embodiments, irrespective of whether material 32 has been removed from passage 28 or not, ignition of output charge 22 will cause frangible member 24 to rupture thereby permitting the escape of energy and hot gases through output end 26 in order to ignite a pyrotechnic material disposed downstream from device 10.

Also contained within output section 14 is a transfer sleeve 34 that contains a transfer charge 36. In certain embodiments, transfer charge 36 may comprise silver azide or other appropriate pyrotechnic material. Transfer sleeve 34 includes rupturable components 38, 40 that seal, and preferably hermetically seal, sleeve 34. Transfer sleeve 34 also seals the input end 42 of chamber 20, thereby completing the hermetic sealing of output charge 22 therein.

Percussion igniter 16 comprises a striking surface 44 configured to be contacted with a firing pin, for example, of a firing initiator. Located immediately beneath striking surface 44 is a primer charge 46 that is configured to be ignited by the kinetic energy transferred to it by a firing pin. Primer charge 46 may comprise black powder or any other suitable pyrotechnic material. A transfer member 48 is located adjacent to primer charge 46 and comprises passageways 50 formed therein, which are operable to direct the output of primer charge 46 toward transfer sleeve 34, through a thin separator material 52. The output of primer charge 46 is operable to ignite transfer charge 36, whose output is operable to ignite output charge 22.

In certain embodiments, output section 14 and percussion igniter 16 are fastened or secured together, such as through press fitting, crimping, or other frictional means of engagement.

Figure 4:
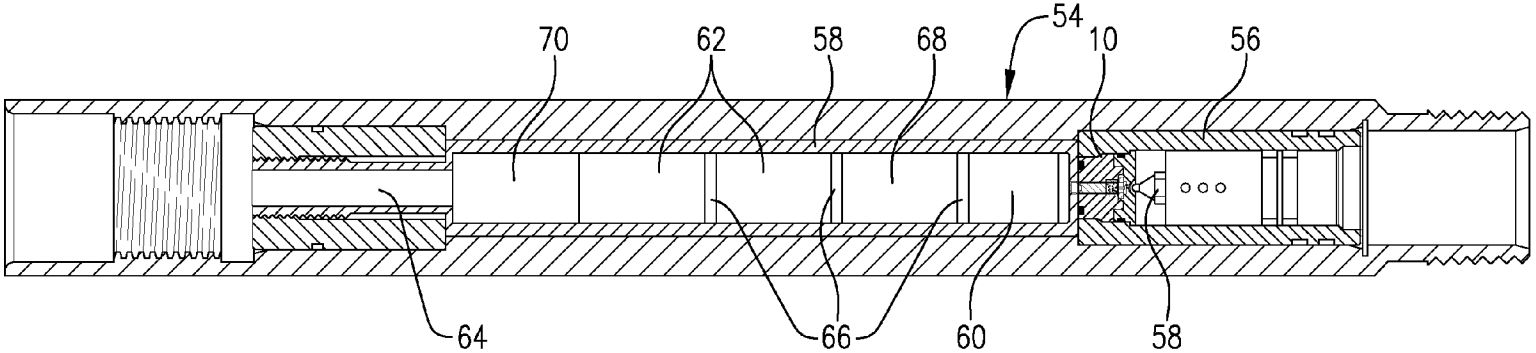
FIG. 4 is a cross-sectional view of a downhole tool comprising the igniter device of FIG. 1 installed in position to ignite a time-delay fuse.

FIG. 4 illustrates an exemplary use of device 10 as a part of a downhole tool 54 operable to set off an explosive charge. Tool 54 may be configured to attachment to a downhole pipe string or other downhole tool. Tool 54 is equipped with a firing head 56 equipped with a firing pin 58 that is configured to contact striking surface 44 of percussion igniter 16. The striking of surface 44 by firing pin 58 initiates an ignition sequence ultimately resulting in ignition of output charge 22. The energy released by output charge 22 can then be used to ignite a time delay fuse 58, for example. It is within the scope of the present invention for other types of pyrotechnic devices to be ignited by device 10 as well. Fuse 58 generally comprises a primer 60, one or more time delays 62, and an output charge 64. In certain embodiments, output charge 64 may comprise 2,2',4,4',6,6'-hexanitrostilbene (HNS-II), or another suitable pyrotechnic material. Other components that may be present within fuse 58 include one or more sections of ignition composition 66, an ignition charge 68, and a transfer charge 70.

Figure 7:
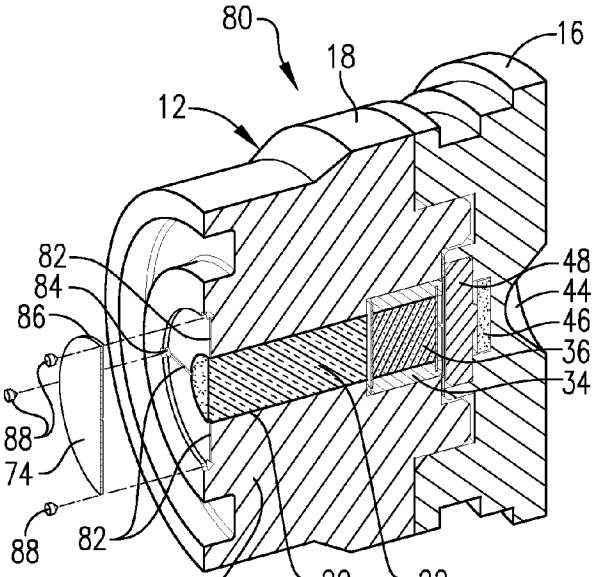
FIG. 7 is a cross-sectional view of the igniter device of FIG. 6 exposing the passages lying beneath the rupture disc.
Figure 6:
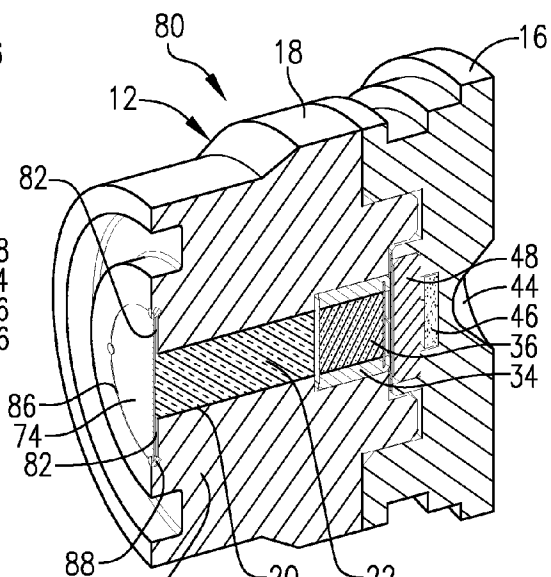
FIG. 6 is a cross-sectional view of yet another embodiment of an igniter device having a plurality of sealed passages.
Figure 5:
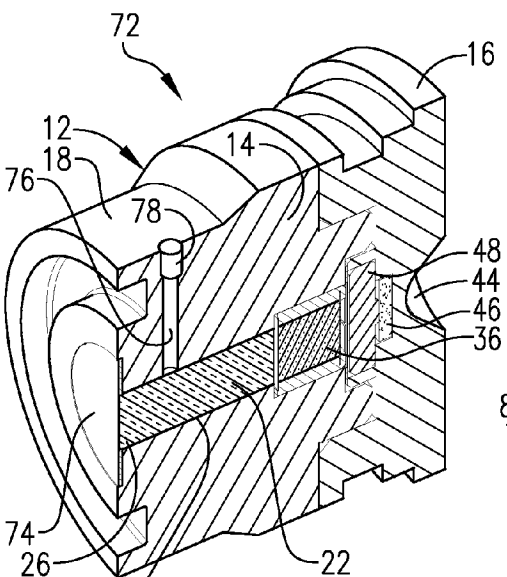
FIG. 5 is a cross-sectional view of another embodiment of an igniter device having a passage formed through the igniter body.

FIGS. 5-7 depict alternate embodiments of a vented igniter device according to the present invention. The embodiments of FIGS. 5-7 are very similar to the embodiment of FIGS. 1-3 discussed above, and certain common components have been labeled with the same reference numerals for convenience. Turning first to FIG. 5, a pyrotechnic igniter device 72 is illustrated comprising a device body 12 including output section 14 and percussion igniter 16. A frangible member 74 seals the output end of interior chamber 20, which contains output charge 22. Unlike the embodiment previously described in which a passage was formed through the frangible member, this embodiment comprises a vent passage 76 that extends from chamber 22, through body 14, and intersects outer sidewall 18. Initially, passage 76 is plugged with a temperature-sensitive material 78, such as that described previously. Material 78 blocks communication between chamber 20 and the exterior of body 12, and preferably, maintains a hermetic seal with chamber 20. Upon exposure of device 72 to an elevated temperature condition of predetermined magnitude, material 78 undergoes a phase change thereby unsealing passage 76 and permitting communication between chamber 20 and the exterior of body 12. Moreover, since passage 76 extend through body 12, and in particular through output section 14, a frangible member 74 may be flat or unmodified as compared to the embodiment of FIGS. 1-3 discussed above.

Turning to the embodiment of FIGS. 6 and 7, a pyrotechnic igniter device 80 is illustrated comprising a device body 12 including output section 14 and percussion igniter 16. In this embodiment, one or more vent passages 82 are provided which define one or more paths disposed between body 12 and frangible member 74. Passages 82 comprise channels formed on an exterior surface of body 12 and are not bounded on all sides by body 12 as is passage 76 of FIG. 5. Passages 82 intersect interior chamber 20 and terminate at segments 84, which are defined by margins that extend at least partially outboard of the outer margin 84 of frangible member 74. Thus, when member 74 is installed in covering relationship to passages 82, at least a portion of segments 84 remain exposed and are capable of communication with the exterior of body 12 around outer margin 84. Passages 82 initially are blocked from communicating with the exterior of body 12 by a temperature-sensitive material 88, such as that previously described herein. Material 88 is disposed within segments 84, preferably hermetically sealing chamber 20. Upon exposure of device 80 to an elevated temperature condition of predetermined magnitude, material 88 undergoes a phase change thereby unsealing passages 82 and permitting communication between chamber 20 and the exterior of body 12.

In other embodiments, the vent passages may simply be defined by a gap disposed between member 74 and body 12. A path for communication of the passage with the exterior of body 12 may be accomplished, for example, by an interruption in the weld seam that secures member 74 to body 12. The temperature-sensitive material 88 may be applied so as to fill in the interrupted segments of the weld seam and provide a hermetic seal for chamber 20.

As noted previously, devices according to the present invention are particularly suited for use in downhole operations where temperatures that exceed the outgassing temperature for the pyrotechnic material contained within the device might be encountered. In particular, the devices according to the present invention permit venting of off gases emitted by the pyrotechnic material under such environmental conditions, but still permit the pyrotechnic material to be hermetically sealed within the device during storage, transportation, and initial downhole deployment.

Accordingly, methods of venting a pyrotechnic device containing a pyrotechnic material according to the present invention comprise providing a pyrotechnic device constructed according to the principles discussed above. In particular, and with exemplary reference to FIGS. 1-3, the pyrotechnic device 10 generally comprises a device body 12 having an interior chamber 20 that contains an explosive output charge 22 sealed therein (preferably a hermetic seal). The device 10 includes a vent passage 28 extending between the chamber 20 and the exterior of the device body 12. The passage includes a temperature-sensitive material 32 disposed therein blocking communication between the chamber 20 and the exterior of the body 12. The device 10 is then introduced into an elevated-temperature environment, such as a subterranean wellbore, in which the temperature conditions are sufficient to cause the temperature-sensitive material 32 to undergo a phase change. The change in phase of material 32 unseals passage 28 thereby opening communication between the chamber 20 and the exterior of the body 12 through the passage 28. As noted above, this change in phase of material 32 generally comprises melting of the material.

As device 10 is lowered deeper into the well bore, warmer temperature conditions may be encountered which causes the pyrotechnic material contained within chamber 20 to outgas. Because chamber 20 is no longer hermetically sealed, the off-gases produced by the pyrotechnic material can escape through passage 28 and into the exterior environment surrounding the device 10, rather than remain entrapped within chamber 20 and accelerate further deactivation of the pyrotechnic material.

In certain embodiments, the elevated-temperature conditions encountered in the wellbore can be between about 150° F. to about 500° F., between about 200° F. to about 450° F., or between about 250° F. to about 400° F. The pyrotechnic device 10 may be exposed to these elevated-temperature conditions for a prolonged period of time before the device is actuated and the pyrotechnic material contained therein ignited. In certain embodiments, the device 10 may be exposed to the elevated-temperature conditions for a period of at least 2 hours, at least 10 hours, at least 25 hours, or at least 50 hours before actuation thereof. The venting of the off gases produced by the pyrotechnic material sufficiently slows thermal degradation of the pyrotechnic material so that it will reliably ignite and provide a useable output, even after such prolonged exposure periods.

The foregoing description of devices and methods according to the present invention are understood to be illustrative, and nothing therein should be taken as a limitation upon the overall scope of the invention.

We claim:

1. A pyrotechnic device comprising:

a device body comprising an outer sidewall and an interior chamber that contains an explosive output charge that is sealed within said body, said chamber comprising opposed input and output ends; and a frangible member disposed in covering relationship to said output end;

said device comprising a vent passage extending between said chamber and the exterior of said body, said vent passage being sealed with a temperature-sensitive material that, upon heating of said device to a predetermined temperature, unseals said vent passage and permits communication between said chamber and the exterior of said body, wherein said temperature-sensitive material unseals said passage at a temperature lower than the outgassing temperature of said output charge.

2. The device according to claim 1, wherein said temperature-sensitive material hermetically seals said chamber until exposure of said device to said predetermined temperature.

3. The device according to claim 1, wherein said temperature-sensitive material unseals said passage at a temperature of between about 150° F. to about 500° F.

4. The device according to claim 1, wherein said temperature-sensitive material comprises a solder.

5. The device according to claim 1, wherein said frangible member comprises a rupture disc.

6. The device according to claim 5, wherein said vent passage is formed through said rupture disc.

7. The device according to claim 5, wherein said passage includes a path defined between said body and said rupture disc.

8. The device according to claim 1, wherein said passage extends from said chamber through said body.

9. The device according to claim 1, wherein said device further comprises a percussion igniter operable to ignite said explosive output charge.

10. The device according to claim 9, wherein said device further comprises a transfer charge configured to receive energy released by said percussion igniter and ignite said explosive output charge.

11. A pyrotechnic igniter comprising:

an igniter body comprising an outer sidewall and an interior chamber containing an explosive output charge that is hermetically sealed within said body, said chamber comprising opposed input and output ends;

a rupture disc disposed in covering relationship to said output end and comprising an orifice formed therethrough that defines a passage extending between said chamber and the exterior of said igniter body, said orifice being hermetically sealed with a solid solder material that, upon heating of said igniter to a predetermined temperature, melts thereby unsealing said passage and permitting communication between said chamber and the exterior of said igniter body; and a percussion igniter operable to ignite said explosive output charge.

12. A method of venting a pyrotechnic device containing a pyrotechnic material comprising:

providing a pyrotechnic device comprising a device body having an interior chamber that contains an explosive output charge sealed therein, said device including a passage extending between said chamber and the exterior of said body, said passage including a temperature-sensitive material disposed therein blocking communication between said chamber and the exterior of said body, said temperature-sensitive material comprising a solder; and introducing said device into an elevated-temperature environment sufficient to melt said solder and unseal said passage thereby opening communication between said chamber and the exterior of said body through said passage, wherein said elevated-temperature environment is a subterranean wellbore.

13. The method according to claim 12, wherein said elevated-temperature environment causes said output charge to release off gases within said chamber.

14. The method according to claim 13, said method including venting at least a portion of said off gases through said passage and into the exterior environment surrounding said body.

15. The method according to claim 12, wherein the temperature of said elevated-temperature environment is between about 150° F. to about 500° F.

16. The method according to claim 12, wherein said method further comprises detonating said explosive output charge after exposure of said pyrotechnic device to said elevated-temperature environment for at least 2 hours.

17. The method according to claim 12, said explosive charge being hermetically sealed within said chamber prior to being introduced into said elevated-temperature environment.

18. A pyrotechnic device comprising:

a device body comprising an outer sidewall and an interior chamber that contains an explosive output charge that is sealed within said body, said chamber comprising opposed input and output ends; and a frangible member disposed in covering relationship to said output end, said device comprising a vent passage extending between said chamber and the exterior of said body, said vent passage being sealed with a temperature-sensitive material that, upon heating of said device to a predetermined temperature, unseals said vent passage and permits communication between said chamber and the exterior of said body, wherein said temperature-sensitive material hermetically seals said chamber until exposure of said device to said predetermined temperature.

19. A pyrotechnic device comprising:

a device body comprising an outer sidewall and an interior chamber that contains an explosive output charge that is sealed within said body, said chamber comprising opposed input and output ends; and a frangible member disposed in covering relationship to said output end, said device comprising a vent passage extending between said chamber and the exterior of said body, said vent passage being sealed with a temperature-sensitive material that, upon heating of said device to a predetermined temperature, unseals said vent passage and permits communication between said chamber and the exterior of said body, wherein said temperature-sensitive material unseals said passage at a temperature of between about 150° F. to about 500° F.

20. A pyrotechnic device comprising:

a device body comprising an outer sidewall and an interior chamber that contains an explosive output charge that is sealed within said body, said chamber comprising opposed input and output ends; and a frangible member disposed in covering relationship to said output end, said device comprising a vent passage extending between said chamber and the exterior of said body, said vent passage being sealed with a temperature-sensitive material that, upon heating of said device to a predetermined temperature, unseals said vent passage and permits communication between said chamber and the exterior of said body, wherein said temperature-sensitive material comprises a solder.

21. A pyrotechnic device comprising:

a device body comprising an outer sidewall and an interior chamber that contains an explosive output charge that is sealed within said body, said chamber comprising opposed input and output ends; and a frangible member disposed in covering relationship to said output end, said device comprising a vent passage extending between said chamber and the exterior of said body, said vent passage being sealed with a temperature-sensitive material that, upon heating of said device to a predetermined temperature, unseals said vent passage and permits communication between said chamber and the exterior of said body, wherein said frangible member comprises a rupture disc, and wherein said vent passage is formed through said rupture disc.

22. A pyrotechnic device comprising:

a device body comprising an outer sidewall and an interior chamber that contains an explosive output charge that is sealed within said body, said chamber comprising opposed input and output ends; and a frangible member disposed in covering relationship to said output end, said device comprising a vent passage extending between said chamber and the exterior of said body, said vent passage being sealed with a temperature-sensitive material that, upon heating of said device to a predetermined temperature, unseals said vent passage and permits communication between said chamber and the exterior of said body, wherein said frangible member comprises a rupture disc, and wherein said passage includes a path defined between said body and said rupture disc.

23. A pyrotechnic device comprising:

a device body comprising an outer sidewall and an interior chamber that contains an explosive output charge that is sealed within said body, said chamber comprising opposed input and output ends; and a frangible member disposed in covering relationship to said output end, said device comprising a vent passage extending between said chamber and the exterior of said body, said vent passage being sealed with a temperature-sensitive material that, upon heating of said device to a predetermined temperature, unseals said vent passage and permits communication between said chamber and the exterior of said body, wherein said passage extends from said chamber through said body.

24. A method of venting a pyrotechnic device containing a pyrotechnic material comprising:

providing a pyrotechnic device comprising a device body having an interior chamber that contains an explosive output charge sealed therein, said device including a passage extending between said chamber and the exterior of said body, said passage including a temperature-sensitive material disposed therein blocking communication between said chamber and the exterior of said body;

introducing said device into an elevated-temperature environment sufficient to cause said temperature-sensitive material to unseal said passage thereby opening communication between said chamber and the exterior of said body through said passage; and detonating said explosive output charge after exposure of said pyrotechnic device to said elevated-temperature environment for at least 2 hours.

25. The method of claim 24, wherein said elevated temperature environment is a subterranean wellbore.

* * * * *